United States Patent [19]

Kofman

[11] Patent Number: 4,955,932

[45] Date of Patent: Sep. 11, 1990

[54] PADLOCK

[76] Inventor: Anatoly Kofman, 8 Tamar Street, Neve Monoson, Israel

[21] Appl. No.: 502,890

[22] Filed: Apr. 2, 1990

[51] Int. Cl.[5] ..... E05B 67/22

[52] U.S. Cl. ..... 70/39; 70/52

[58] Field of Search ..... 70/39, 52, 38 R, 38 A, 70/38 B, 38 C, 26

[56] References Cited

U.S. PATENT DOCUMENTS 4,112,715 9/1978 Upeda ..... 70/38 A 4,216,664 8/1980 Slavinsky ..... 70/39

FOREIGN PATENT DOCUMENTS 86122 11/1921 Austria ..... 70/52

*Primary Examiner*—Robert L. Wolfe

*Attorney, Agent, or Firm*—Benjamin J. Barish

[57] ABSTRACT

A padlock, comprising: a housing formed with a pair of sockets, a shackle receivable in and removable from said sockets and a pair of locking bolts projectable into said sockets for locking the shackle therein and retractable from said sockets to permit removal from the shackle therefrom; characterized in that said housing includes a body member carrying said locking bolt, and a pair of sleeves defining said sockets; said sleeves being removably attached to opposite sides of said body member by fasteners received in said sockets so as not to be accessible when the shackle is locked within said sleeves.

13 Claims, 1 Drawing Sheet

PADLOCK

BACKGROUND OF THE INVENTION

The present invention relates to a padlock. The invention is particularly applicable for padlocks of the key-operated type, and is therefore described below with respect to this application, but it will be appreciated that the invention could also advantageously be used in other types of padlock, e.g. of the combination type.

The typical padlock comprises a housing formed with a pair of sockets for receiving a shackle, and a pair of locking bolts for locking the shackle within the sockets. In the conventional construction, the housing is intergrally formed with the sockets for the shackle, and also with a bore for receiving the key-operated cylinder, or the combination-operated cylinder, according to the type of padlock.

OBJECTS AND SUMMARY OF THE INVENTION

An object of the present invention is to provide a padlock of a construction consisting of a few simple parts which can be produced in volume and at low cost and which can be quickly assembled into the padlock, or quickly disassembled for repair or maintenance purposes.

According to the present invention, there is provided a padlock comprising a housing formed with a pair of sockets, a shackle receivable in and removable from the sockets, and a pair of locking bolts projectable into the sockets for locking the shackle therein and retractable from the sockets to permit removal from the shackle therefrom housing includes a body member carrying the locking bolt, and a pair of sleeves defining the sockets. The sleeves are removably attached to opposite sides of the body member by fasteners received in the sockets so as not to be accessible when the shackle is locked within the sleeves.

According to further features in the described preferred embodiment, the sleeves are of circular section, and the body member is formed at its opposite sides with concavities complementary to the circular section of the sleeves. The opposite sides of the body member include laterally-projecting stems. Each of the sleeves has as open upper end and a lower end enclosed by a thick wall having a blind bore therethrough for receiving the stems. Each of the sleeves is formed with a conical recess on its side facing the open upper end of the sleeve, and the fastener is formed with a conical tip recieved in the conical recess.

According to still further features in the described perferred embodiment, the shackle is of U-shape configuration, having a pair of straight parallel legs formed with notches on their inner faces and joined by a curved leg. Each of the sleeves is formed with a hole in its inner side to permit the locking bolt to pass therethrough to seal in the notches for locking the shackle. In addition, the sleeves are longer than the straight parallel legs of the shackle, and are formed with cut-outs on their inner faces for accomodating the straight parallel legs of the shackle.

As indicated earlier, the invention of the present application is particularly useful for padlocks of the key-operated type, whereby the body member of the lock housing would include a key-operated cylinder for projecting and retracting the locking bolts. It is contemplated however, that the invention could also be used in other types of padlock, e.g. the combination type.

It will be seen that the foregoing features of the invention enable padlocks to be constructed of a few relatively simple parts which can be produced in volume and at low cost, and which can be conveniently assembled or disassembled.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
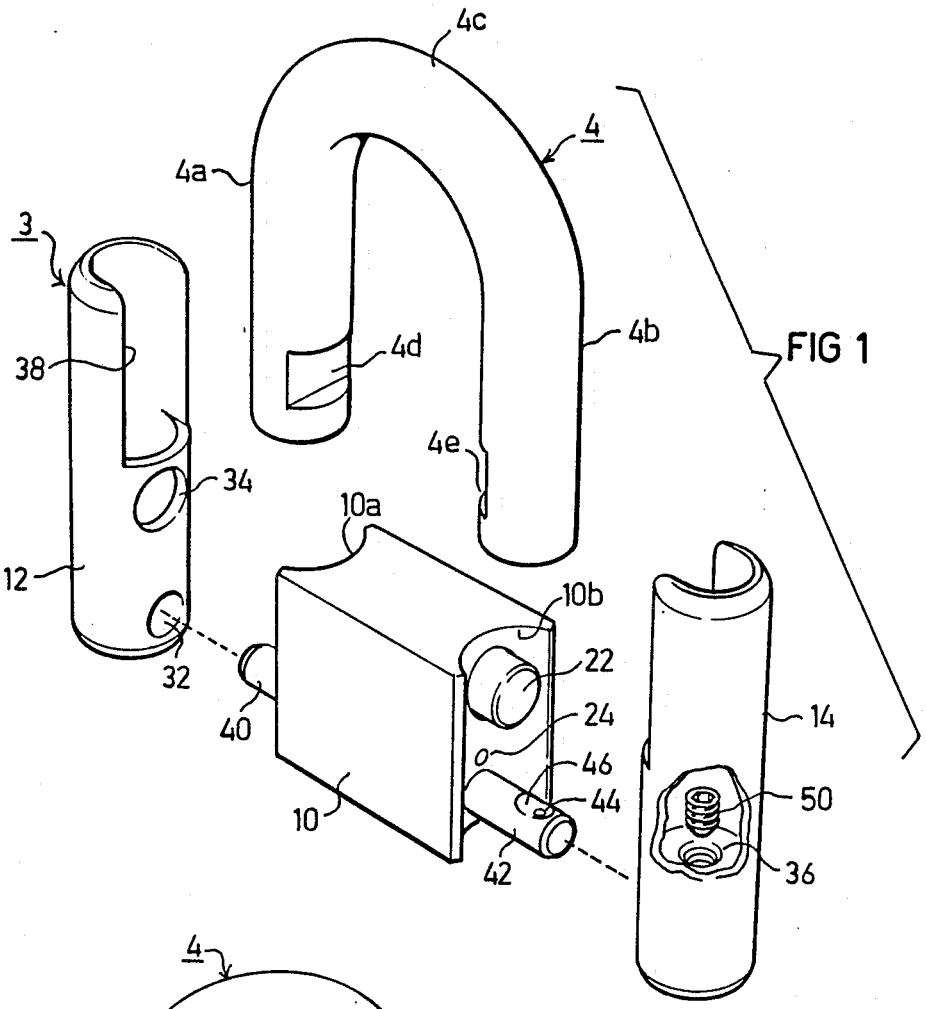
FIG. 1 is an exploded perspective view illustrating the main elements of a padlock constructed in accordance with the present invention.

The padlock illustrated in the drawings comprises a housing, generally designated 2, and a U-shaped shackle, generally designated 4, receivable in and removable from the housing. Shackle 4 may be of the conventional U-shape construction, but housing 2 is of a novel construction as described more particularly below.

Thus, housing 2 comprises a body member 10 and a pair of sleeves 12,14 removably attached to the sides of the body member. Body member 10 is formed with a longitudally-extending bore 16 for receiving a cylinder 18 operated by a key 20. Cylinder 18 contains a pair of locking bolts, one which is shown at 22, which are actuated by key 20 to a projected locking position (illustrated in FIG. 2) or to a retracted releasing position.

The cylinder 18 may be fixed within, or removed from, the body member 10 by means of pair of screws 24 passing through the sides of the body member and normally covered by the sleeves 12 and the ends of the shackle 4 in the locked condition of the padlock.

Cylinder 18, its key 20, and its locking bolt 22, may all be of a conventional construction, and therefore further details of their construction are not set forth herein.

As shown particularly in FIG. 1, the two removable sleeves 12, 14 are of circular section. Body member 10 is of generally rectangular configuration but is formed at its opposite sides with concavities 10*a*, 10*b*, complemenatry to the circular section of the sleeves 12, 14.

The two sleeves 12, 14 are of identical construction. Each is formed with an open upper end and a lower end closed by a relatively thick bottom wall 30 formed with a blind bore 32 extending from its inner face but terminating short of its outer face. Each sleeve 12,14 is further formed with another bore 34 for accomodating its respective locking bolt 22. Each sleeve 12, 14, is further formed with a threaded bore 36 starting from the inner face of its thickened bottom wall 30 and extending axially therethrough to its bore 32. Finally, each sleeve is formed with a rectangular cut-out 38 starting from just above its bore 34 receiving the locking bolts 32, and the open end of the sleeve.

Each of the concave sides 10, 10*b* of body member 2 is integrally formed with a laterally-projecting stem 40, 42, receivable within bores 32 of the two sleeves 12, 14. In addition, each of the stems, 40, 42 is formed with a small bore 44 whose upper end terminates in a conical recess 46 formed in the upper face of the respective stem.

Each of the sleeves 12,14 is secured to the body member 10 by means of a setscrew 50 threadedly received in bore 30 of the respective sleeve and having a conical tip received within the conical recess 46 of the respective stem 40, 42. Thus, when the shackle 4 is received and locked within the sleeves 12,14, it covers the setscrews 50 so that the setscrews are accessible only when the shackle is removed from the sleeves.

Shackle 4, includes a pair of straight, parallel legs **4*a*, 4*b* joined by a curved leg 4*c*. The inner faces of the two straight legs 4*a*, 4*b* are formed with rectangular notches 4*d*, 4*e*, for receiving the locking bolts 22**.

Figure 2:
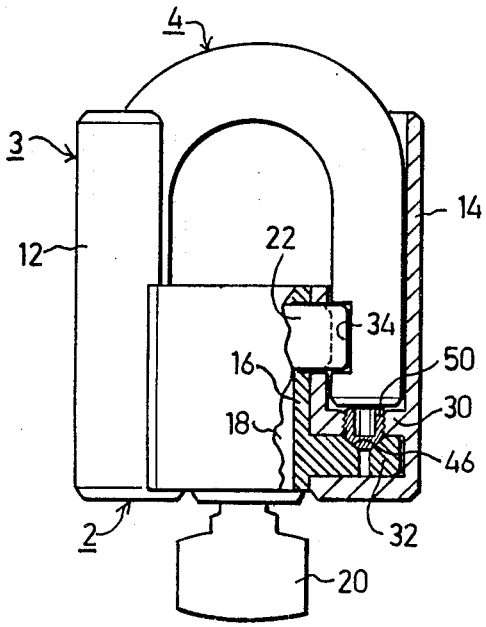
FIG. 2 is a side elevational view, partly in section of the padlock of FIG. 1 in its assembled condition.

As can be seen in FIG. 2, the sleeves 12, 14, are longer than the straight legs **4*a*, 4*b* of shackle 4. However, this greater length of the sleeves does not interfere with the insertion and removal of the shackle because of the cut-outs 38**.

The manner of assembling and using the illustrated padlock will be apparent from the above description. Thus, the housing may be easily assembled by applying the two sleeves 12,14 against the concave faces **10*a*, 10*b* of the body member 10, with the two stems 40, 42 received within the openings 32 of the sleeve. The setscrews 50 are then applied to securely fasten the two sleeves to the stems. When the sleeves 12, 14 are thus secured to the body member 10, their openings 34 are in alignment with the locking bolts 22 of the cylinder lock 18**.

Shackle 4 may thus be inserted within the sleeves 12,14, and the locking bolts 22 may then be projected into the shackle notches **4*d*, 4*e*, by the operation of the key 20 to thereby lock the shackle. When the locking bolts 22 are retracted by the use of the key 20**, the shackle may be removed from the sleeves.

It will thus be seen that the illustrated padlock is constructed of a few simple parts which can be produced in volume and at low cost, and which can be conveniently assembled or disassembled for replacement of parts. It will also be seen that the sleeves 12, 14 more effectively guide the shackle during the locking or releasing operations. They also provide additional protection against breaking the lock by sawing through the shackle legs **4*a*, 4*b***.

While the invention has been described with respect to one preferred embodiment, it will be appreciated that many variations may be made. For example, the invention could be used with a padlock of the combination type as indicated earlier. Other variations, modifications and applications of the invention will be apparent.

What is claimed is:

1. A padlock, comprising: a housing formed with a pair of sockets, a shackle receivable in and removable from said sockets, and a pair of locking bolts projectable into said sockets for locking the shackle therein and retractable from said sockets to permit removal from the shackle therefrom;

characterized in that said housing includes a body member carrying said locking bolt, and a pair of sleeves defining said sockets;

said sleeves being removably attached to opposite sides of said body member by fasteners received in said sockets so as not to be accessible when the shackle is locked within said sleeves.

2. The padlock according to claim 1, wherein said sleeves are of circular section, and said body member is formed at its opposite sides with concavities complementary to the circular section of said sleeves.

3. The padlock according to claim 1, wherein said opposite sides of the body member include laterally projective stems, said sleeves each having as open upper end and a lower end closed by a thick wall having a blind bore therethrough for receiving said stems.

4. The padlock according to claim 3, wherein each of said stems is formed with a conical recess on its side facing the open upper end of the sleeve, and said fastener is formed with a conical tip received in said conical recess.

5. The padlock according to claim 1, wherein said shackle is of U-shape configuration, having a pair of straight parallel legs formed with notches on their inner faces and joined by a curved connecting leg, each of said sleeves being formed with a hole in its inner side to permit the locking bolts to pass therethrough to seal in said notches for locking the shackle to the body member.

6. The padlock according to claim 5, wherein said sleeves are longer than the straight parallel legs of the shackle, and are formed with cut-outs on their inner faces for accomodating the straight parallel legs of the shackle.

7. The padlock according claim 1, wherein said body member of the lock housing includes a key-operated cylinder for projecting and retracting said locking bolts.

8. A padlock, comprising:

a housing formed with a pair of sockets;

a shackle receivable in and removable from said sockets;

a pair of locking bolts projectable into said sockets for locking the shackle therein and retractable from said sockets to permit removal from the shackle therefrom;

a key-operated cylinder for projecting and retracting said locking bolts;

said housing including a body member carrying said locking bolt, and a pair of sleeves defining said sockets;

said sleeves being removably attached to opposite sides of said body member by fasteners received in said sockets so as not to be accessible when the shackle is locked within said sleeves.

9. The padlock according to claim 8, wherein said sleeves are of circular section, and said body member is formed at its opposite sides with concavities complementary to the circular section of said sleeves.

10. The padlock according to claim 9, wherein said opposite sides of the body member include laterally-projective stems, said sleeves each having as open upper end and a lower end closed by a thick wall having a blind bore therethrough for receiving said stems.

11. The padlock according to claim 10, wherein each of said stems is formed with a conical recess on its side facing the open upper end of the sleeve, and said fastener is formed with a conical tip received in said conical recess.

12. The padlock according to claim 8, wherein said shackle is of U-shape configuration, having a pair of straight parallel legs formed with notches on their inner faces and joined by a curved connecting leg, each of said sleeves being formed with a hole in its inner side to permit the locking bolts to pass therethrough to seal in said notches for locking the shackle to the body member.

13. The padlock according to claim 12, wherein said sleeves are longer than the straight parallel legs of the shackle, and are formed with cut-outs on their inner faces for accomodating the straight parallel legs of the shackle.

* * * * *